US008944934B2

(12) United States Patent
Yamamoto

(10) Patent No.: US 8,944,934 B2
(45) Date of Patent: Feb. 3, 2015

(54) GOLF CLUB HEAD

(71) Applicant: Dunlop Sports Co. Ltd., Kobe-shi, Hyogo (JP)

(72) Inventor: Akio Yamamoto, Kobe (JP)

(73) Assignee: Dunlop Sports Co., Ltd., Kobe (JP)

( * ) Notice: Subject to any disclaimer, the term of this patent is extended or adjusted under 35 U.S.C. 154(b) by 108 days.

(21) Appl. No.: 13/711,853

(22) Filed: Dec. 12, 2012

(65) Prior Publication Data

US 2013/0150180 A1 Jun. 13, 2013

(30) Foreign Application Priority Data

Dec. 13, 2011 (JP) ..... 2011-271831

(51) Int. Cl.
*A63B 53/04* (2006.01)
*A63B 53/06* (2006.01)
*A63B 59/00* (2006.01)

(52) U.S. Cl.
CPC ..... *A63B 53/0466* (2013.01); *A63B 59/0074* (2013.01); *A63B 2053/0491* (2013.01)
USPC ..... 473/334; 473/335; 473/338; 473/339; 473/349

(58) Field of Classification Search
USPC ..... 473/324–350, 287–292, 256; 411/337–339, 354, 432
See application file for complete search history.

(56) References Cited

U.S. PATENT DOCUMENTS

| | | | | |
|---|---|---|---|---|
| 7,628,711 | B2 * | 12/2009 | Akinori et al. | 473/335 |
| 7,686,707 | B2 * | 3/2010 | Matsunaga et al. | 473/332 |
| 7,744,484 | B1 * | 6/2010 | Chao | 473/324 |
| 8,182,363 | B2 * | 5/2012 | Bezilla et al. | 473/335 |
| 8,192,302 | B2 * | 6/2012 | Knutson et al. | 473/335 |
| 2003/0162608 | A1 * | 8/2003 | Chen | 473/345 |
| 2006/0240907 | A1 * | 10/2006 | Latiri | 473/334 |
| 2006/0276263 | A1 * | 12/2006 | Lin et al. | 473/338 |
| 2007/0129161 | A1 * | 6/2007 | Matsunaga et al. | 473/332 |
| 2008/0015049 | A1 * | 1/2008 | Imamoto | 473/338 |
| 2008/0039229 | A1 * | 2/2008 | Lo | 473/335 |
| 2009/0131200 | A1 | 5/2009 | Akinori et al. | |
| 2014/0024475 | A1 * | 1/2014 | Motokawa | 473/338 |
| 2014/0038743 | A1 * | 2/2014 | Nivanh | 473/324 |

* cited by examiner

*Primary Examiner* — Sebastiano Passaniti
(74) *Attorney, Agent, or Firm* — Birch, Stewart, Kolasch & Birch, LLP

(57) ABSTRACT

A head 4 includes a head body h1, a socket 10, and a weight body 12. The weight body 12 has an engaging part 32. The socket 10 has a first hole part 18 and a second hole part 20. The engaging part 32 can take an engaging position EP and a non-engaging position NP in the second hole part 20 by relative rotation of an angle θ. Hardness Hs of the second hole part 20 is D40 or greater and D58 or less. The second hole part 20 has a resistance surface 84 elastically deformed in the middle of the relative rotation. A longest sectional size of the engaging part 32 is defined as d1, and a distance between the resistance surfaces 84 opposed to each other is defined as F1, a ratio (F1/d1) is 0.935 or greater and 0.965 or less.

18 Claims, 10 Drawing Sheets

GOLF CLUB HEAD

The present application claims priority on Patent Application No. 2011-271831 filed in JAPAN on Dec. 13, 2011, the entire contents of which are hereby incorporated by reference.

BACKGROUND OF THE INVENTION

1. Field of the Invention

The present invention relates to a golf club head having a weight body.

2. Description of the Related Art

A head capable of changing the mass and position of a weight body has been known. The position of the center of gravity of the head can be adjusted by the weight body attached to the head. The adjustment of the center of gravity facilitates fitting.

As a mechanism for attaching the weight body, a screw mechanism is typical. On the other hand, Japanese Utility Model Registration No. 3142270 (US2009/0131200) discloses a mechanism including a sleeve and a weight. The gazette discloses a weight capable of being attached/detached by rotation.

SUMMARY OF THE INVENTION

An impulse force acts on the head in hitting. The weight body capable of resisting repeated hitting is preferable. In addition, it is preferable that the weight body is easily attached/detached. The easiness and durability of attachment/detachment are preferably improved.

It is an object of the present invention to provide a golf club head to/from which a weight body can be attached/detached and which has excellent reliability.

A golf club head according to the present invention includes a head body; a socket attached to the head body; and a weight body capable of being attached/detached to/from the socket. The weight body can be attached/detached by relative rotation of an angle θ to the socket. The weight body has an engaging part. The socket has a first hole part and a second hole part. Hardness Hs of the second hole part is D40 or greater and D58 or less. The engaging part can take an engaging position EP and a non-engaging position NP in the second hole part by the relative rotation of the angle θ. The second hole part has a resistance surface elastically deformed in the middle of the relative rotation. When a longest sectional size of the engaging part is defined as d1, and a distance between the resistance surfaces opposed to each other is defined as F1, a ratio (F1/d1) is 0.935 or greater and 0.965 or less.

Preferably, when the distance between the opposed surfaces of the engaging part is defined as c1, and an opening width of the first hole part is defined as K1, a difference (K1−c1) is 0.3 mm or greater and 0.6 mm or less.

Preferably, when a cross length of the second hole part between positions with which both end points p1 of a longest cross line Lm of the engaging part are brought into contact at the engaging position EP is defined as G1, a ratio (G1/d1) is 0.987 or greater and 0.996 or less.

Preferably, the head further includes a bottom face forming part made of the same kind of material as that of the socket.

Preferably, when maximum torque required in attaching/detaching under an environment of 40° C. is defined as T40, and maximum torque required in attaching/detaching under an environment of 5° C. is defined as T5, a ratio (T40/T5) is equal to or greater than 0.30.

Preferably, a material of the second hole part is an urethane-based polymer.

The present invention can provide a golf club head to/from which a weight body can be attached/detached and which has excellent reliability.

DESCRIPTION OF THE PREFERABLE EMBODIMENTS

Hereinafter, the present invention will be described below in detail based on the preferable embodiments with appropriate references to the accompanying drawings.

A golf club head of the embodiment has a weight body attaching/detaching mechanism. The mechanism satisfies the Golf Rules defined by R&A (Royal and Ancient Golf Club of St Andrews). That is, the weight body attaching/detaching mechanism satisfies requirements specified in "1b Adjustability" in "1 Clubs" of "Appendix II Design of Clubs" defined by R&A. The requirements defined by the "1b Adjustability" are the following items (i), (ii), and (iii):

(i) the adjustment cannot be readily made;

(ii) all adjustable parts are firmly fixed and there is no reasonable likelihood of them working loose during a round; and (iii) all configurations of adjustment conform with the Rules.

Figure 1:
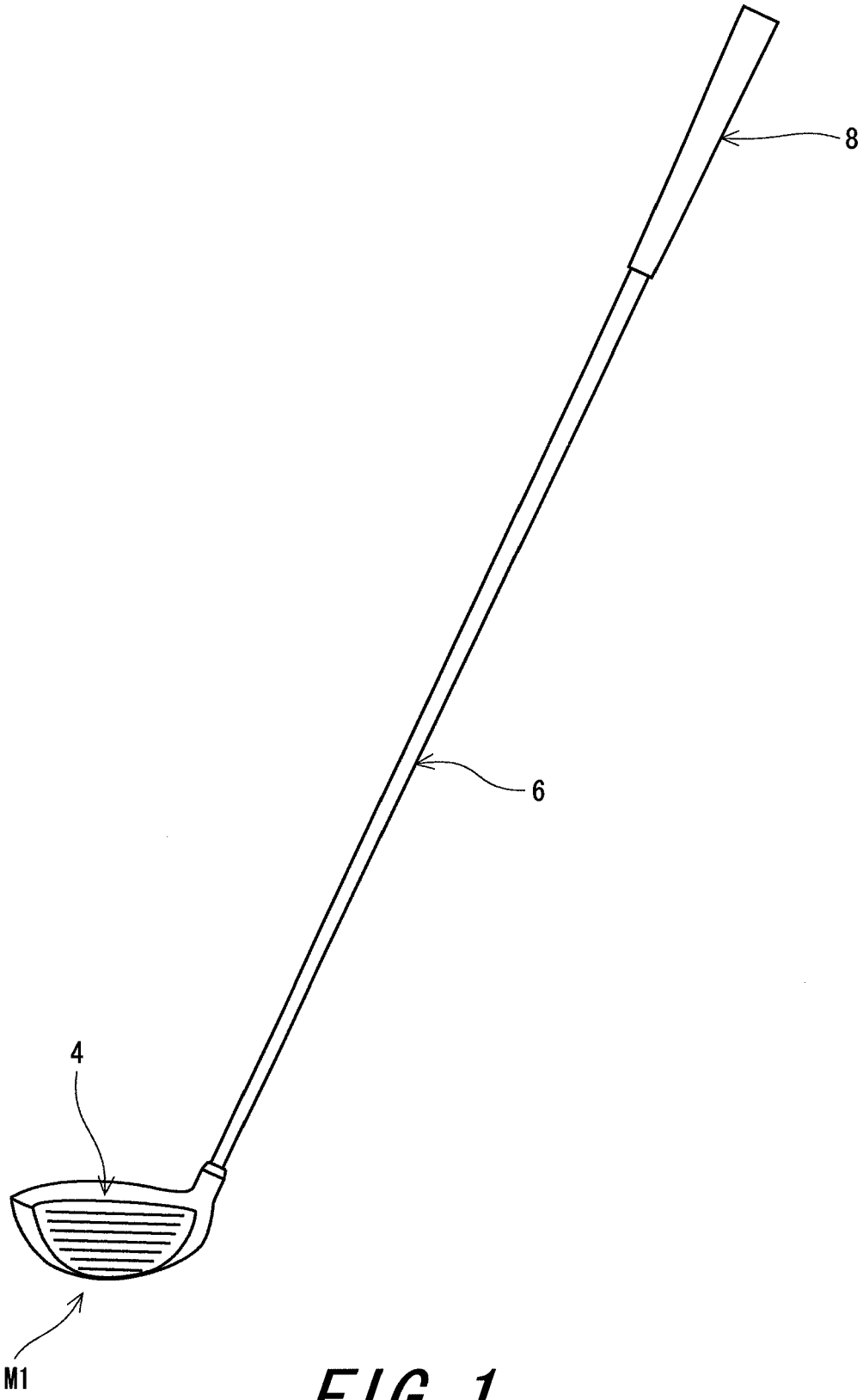
FIG. 1 shows a golf club having a head according to an embodiment of the present invention.

FIG. 1 shows a golf club 2 provided with a head 4 of a first embodiment. The golf club 2 is provided with the head 4, a shaft 6, and a grip 8. The head 4 is attached to one end part of the shaft 6. The grip 8 is attached to the other end part of the shaft 6.

The head 4 is a wood type head. The head 4 is exemplary. A utility type head, a hybrid type head, an iron type head, and a putter type head may be used in place of the head 4. The shaft 6 is a tubular body. Examples of the shaft 6 include a steel shaft and a so-called carbon shaft.

Figure 2:
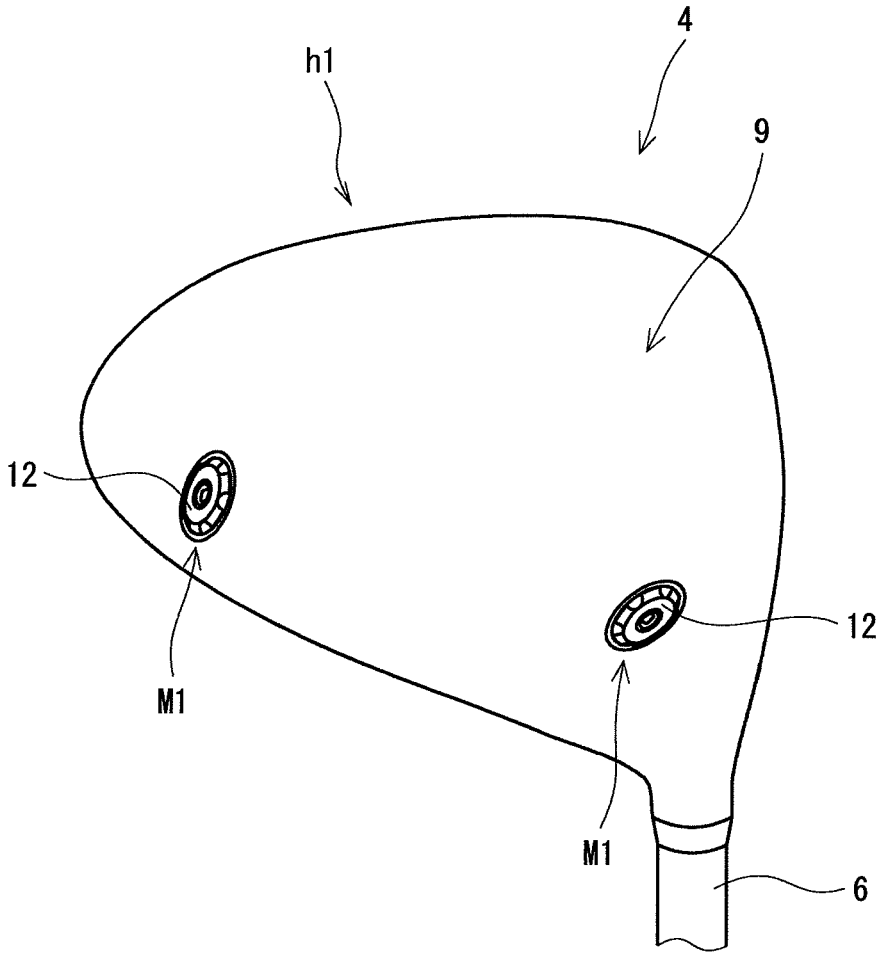
FIG. 2 is a perspective view of the vicinity of a sole of the head of FIG. 1.
Figure 3:
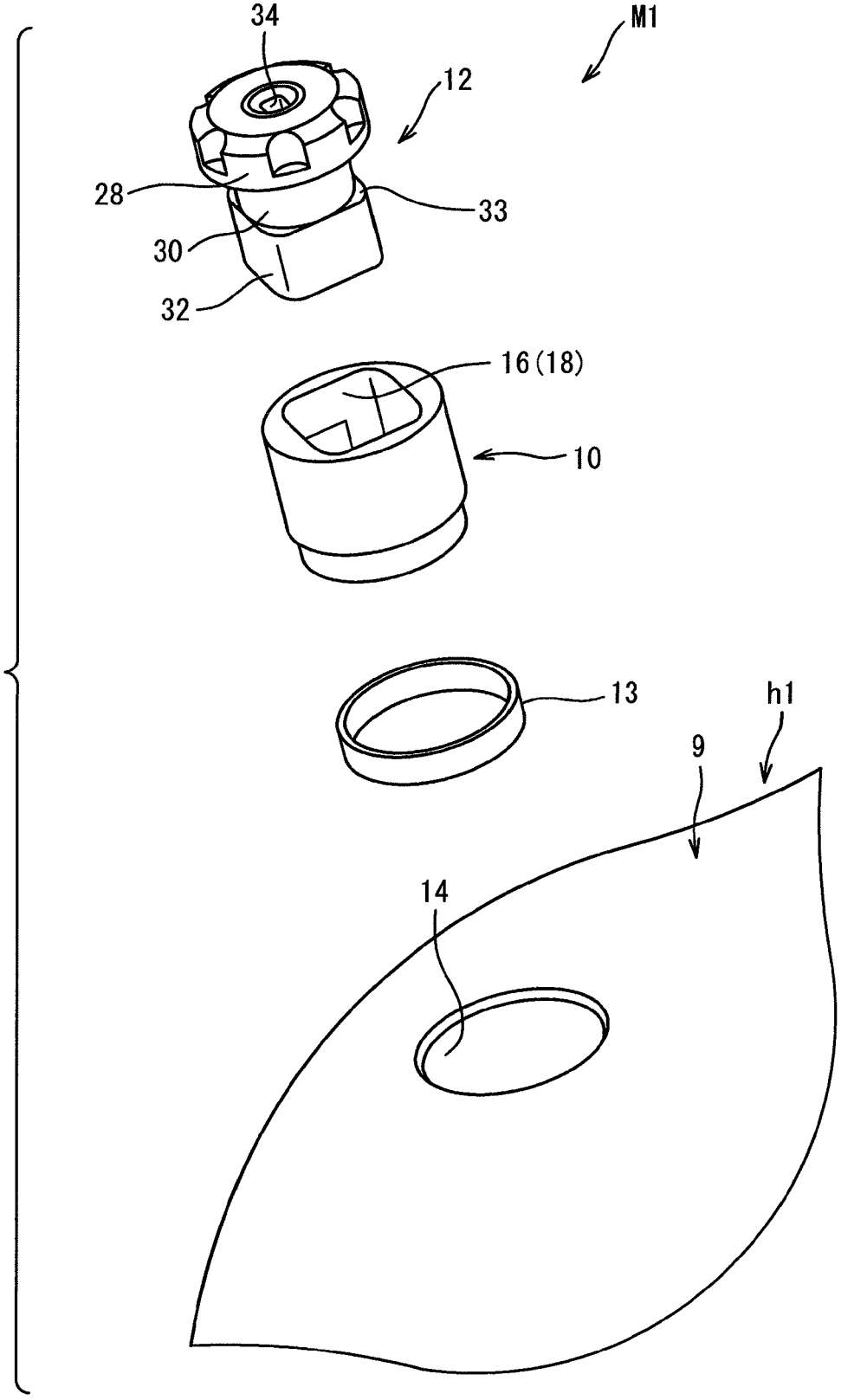
FIG. 3 is an exploded perspective view of a weight body attaching/detaching mechanism.

FIG. 2 is a perspective view of the golf club 2 viewed from a sole 9 side of the head 4. The head 4 has a head body h1 and a weight body attaching/detaching mechanism M1. FIG. 3 is an exploded perspective view of the weight body attaching/detaching mechanism M1. The weight body attaching/detaching mechanism M1 is provided with a socket 10 and a weight body 12. Furthermore, the weight body attaching/detaching mechanism M1 has a bottom face forming part 13.

The head body h1 is provided with a recessed part 14. The shape of the recessed part 14 corresponds to that of the socket 10. The inner diameter of the recessed part 14 is substantially equal to the outer diameter of the socket 10. The number of the recessed parts 14 is the same as that of the weight body attaching/detaching mechanisms M1. In the embodiment, two recessed parts 14 are provided.

The bottom face forming part 13 may be integrally formed with the socket 10. The bottom face forming part 13 may not exist.

The socket 10 is fixed in the recessed part 14. The fixation is attained by an adhesive, for example. The weight body 12 is detachably attached to the socket 10. Therefore, the weight body 12 can be attached/detached to/from the head 4.

In the embodiment, a plurality of weight body attaching/detaching mechanisms M1 is provided. In the head 4, two weight body attaching/detaching mechanisms M1 are provided. The number of the weight body attaching/detaching mechanisms M1 is not limited. The position of the weight body attaching/detaching mechanism M1 is not limited.

Figure 4:
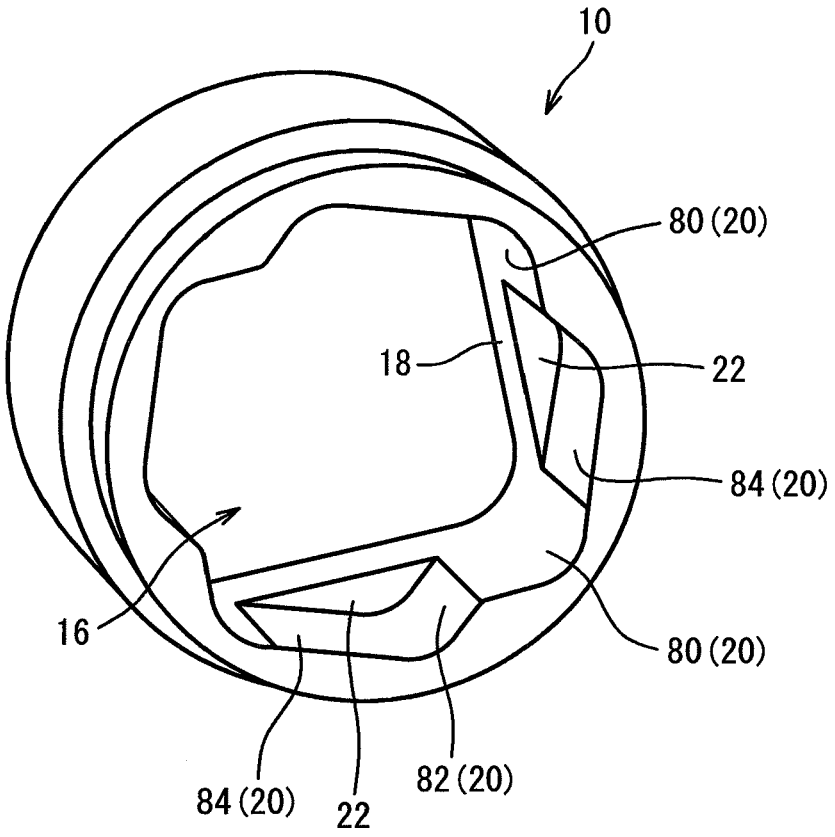
FIG. 4 is a perspective view of a socket shown in FIG. 3.
Figure 5:
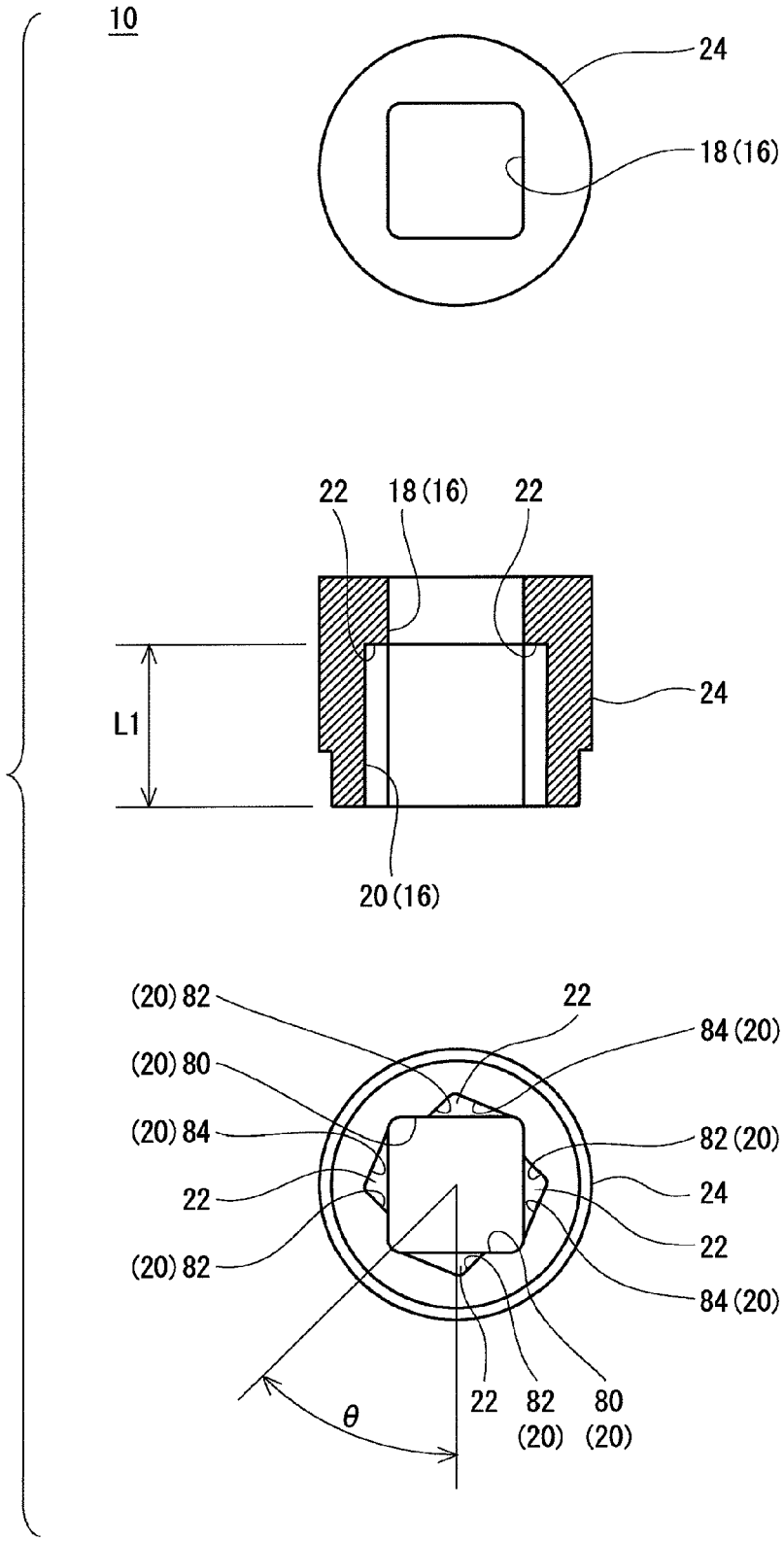
FIG. 5 is a plan view, a cross sectional view, and a bottom view of the socket shown in FIG. 3.
Figure 6:
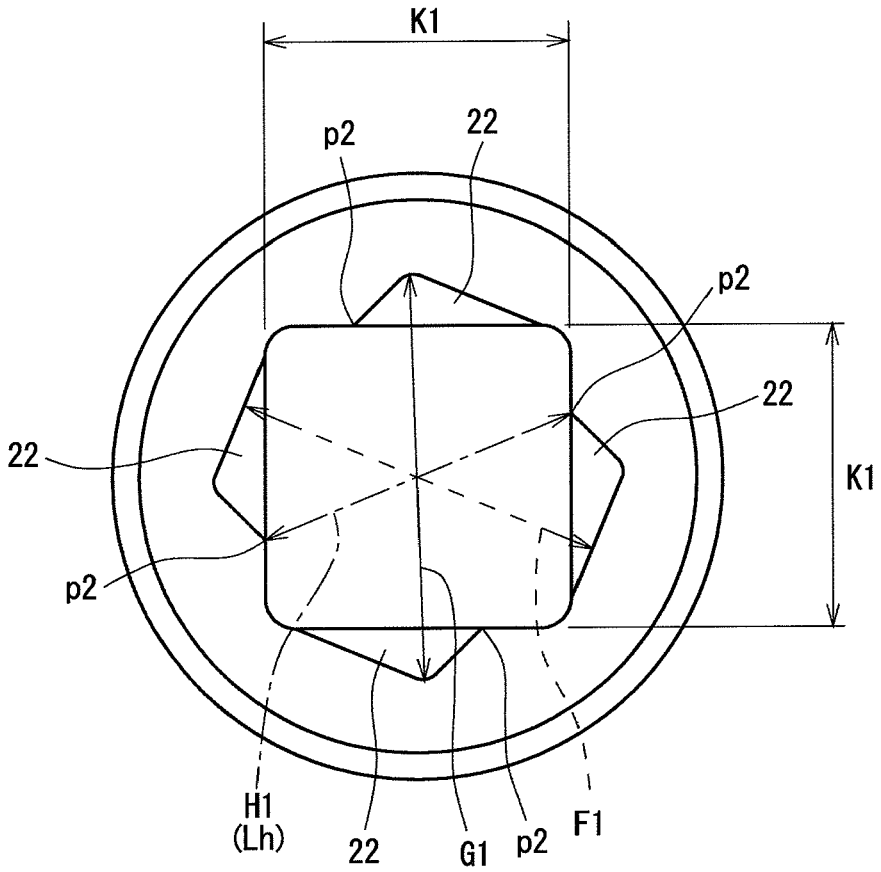
FIG. 6 is an enlarged view of the bottom view of the socket shown in FIG. 5.

FIG. 4 is a perspective view of the socket 10. FIG. 4 is a perspective view of the socket 10 viewed from a bottom face side. FIG. 5 shows a plan view of the socket 10, a cross sectional view of the socket 10, and a bottom view of the socket 10 in this order from the top. FIG. 6 is an enlarged view of the bottom view of FIG. 5. As shown in FIGS. 4 and 5, the socket 10 has a hole 16.

The hole 16 has a first hole part 18, a second hole part 20, and a bump surface 22. A side surface 24 of the socket 10 is a cylindrical surface. The hole 16 extends through the socket 10. The hole 16 may not extend through the socket 10. The whole inner surface of the first hole part 18 smoothly continues. The whole inner surface of the second hole part 20 smoothly continues.

The sectional shape (see the plan view of FIG. 5) of the first hole part 18 is substantially equal to that of an engaging part 32 of the weight body 12. In the embodiment, the sectional shape of the first hole part 18 and the sectional shape of the engaging part 32 are substantially squares. These substantial squares are obtained by applying roundness to four corners of the square. It is preferable that a length L1 of the second hole part 20 is substantially equal to a length L11 of the engaging part 32 of the weight body 12, or is shorter than the length L11.

Preferably, the material of the socket 10 is a polymer. The polymer is comparatively hard. When the weight body 12 is attached/detached, the polymer can be elastically deformed. The attaching/detaching scheme will be described later. The structure of the second hole part 20 of the hole 16 will be also described later.

Figure 7:
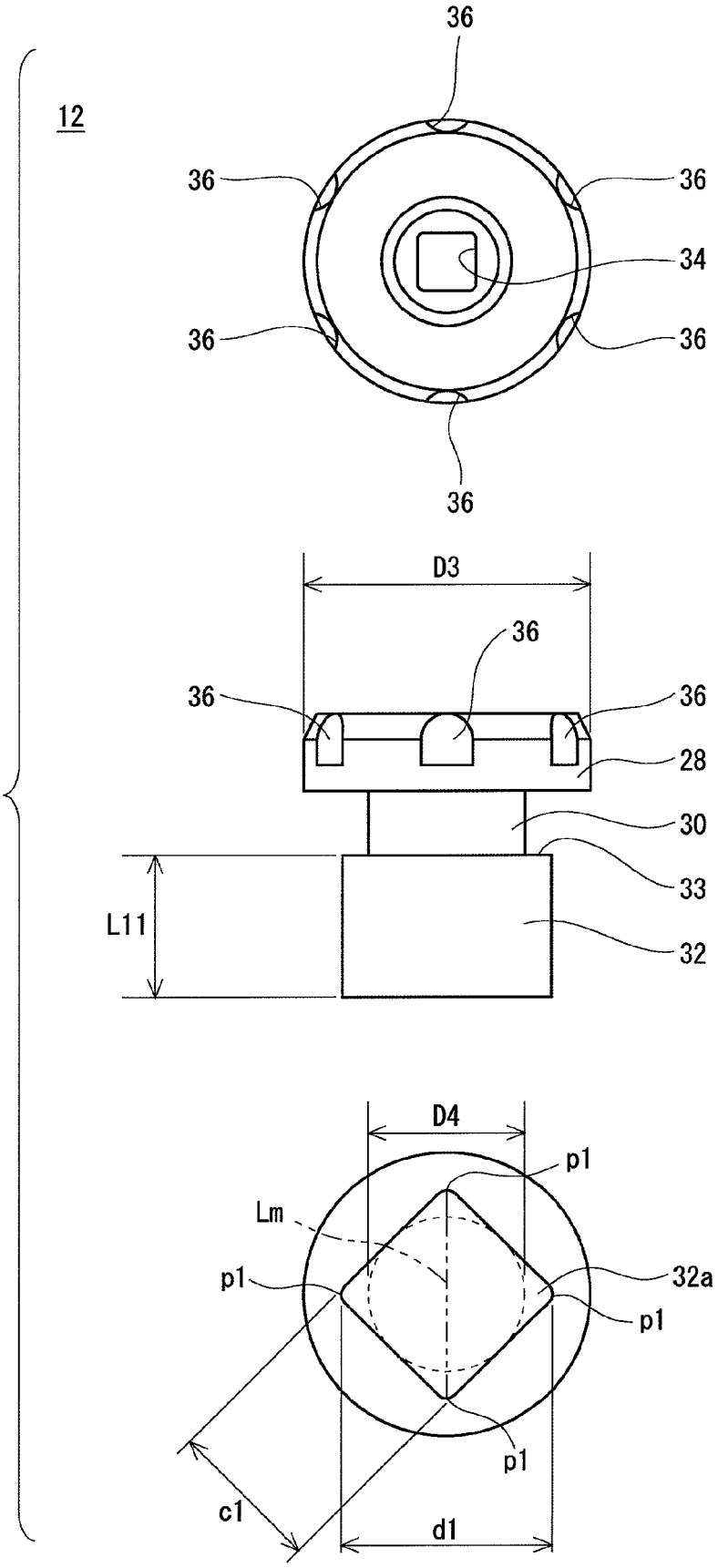
FIG. 7 is a plan view, a side view, and a bottom view of a weight body shown in FIG. 3.

FIG. 7 shows a plan view, a side view, and a bottom view of the weight body 12 in this order from the top. As shown in FIG. 7, the weight body 12 has a head part 28, a neck part 30, and the engaging part 32. The neck part 30 has a cylindrical shape. A noncircular hole 34 is formed at a center of an upper end face of the head part 28. In the embodiment, the noncircular hole 34 has a quadrangle shape. A plurality of cutouts 36 is formed in an outer peripheral surface of the head part 28. The head part 28 has an outer diameter D3 greater than an outer diameter D4 of the neck part.

The engaging part 32 has a noncircular section. In the embodiment, the section is a substantially square. The engaging part 32 can pass through the first hole part 18 of the hole 16. The engaging part 32 is a quadranglar prism. A size c1 is the same as the outer diameter D4 of the neck part 30. A size d1 is greater than the outer diameter D4 of the neck part 30. A recessed part may be formed in a lower end face of the engaging part 32. Amass of the weight body 12 can be adjusted by a volume of a space formed by the recessed part. The size c1 and the size d1 will be described later.

The engaging part 32 has a corner part 32*a* as a protruding part. The corner part 32*a* protrudes to a direction (hereinafter, also referred to as an axial perpendicular direction) perpendicular to a center axis line of the weight body 12.

The engaging part 32 has an engaging surface 33. The engaging surface 33 is formed by a difference between the sectional shapes of the engaging part 32 and the neck part 30.

Preferably, the weight body 12 has a specific gravity greater than that of the socket 10. In respect of durability and specific gravity, the material of the weight body 12 is preferably a metal. Examples of the metal include an aluminium alloy, a titanium alloy, stainless steel, a tungsten alloy, and a tungsten nickel alloy (W—Ni alloy).

Figure 8:
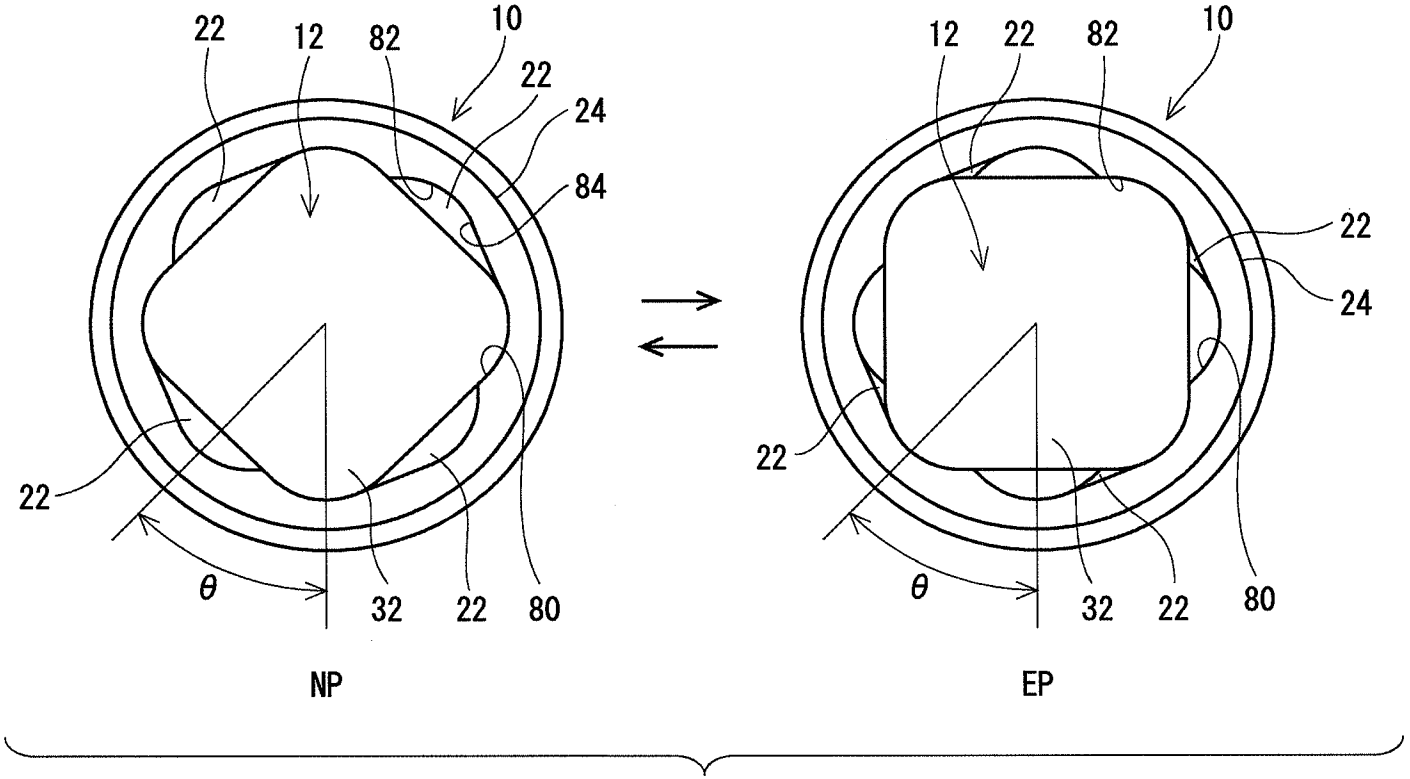
FIG. 8 shows a mutual transition of a non-engaging position NP and an engaging position EP, and is a bottom view thereof.

FIG. 8 shows a non-engaging position NP and engaging position EP of the weight body attaching/detaching mechanism M1. FIG. 8 is a bottom view of a state where the weight body 12 is inserted into the socket 10. The bottom face forming part 13 is not attached in FIG. 8.

As a relative relationship between the socket 10 and the weight body 12, the non-engaging position NP and the engaging position EP can be taken. At the non-engaging position NP, the weight body 12 can be extracted from the socket 10. On the other hand, at the engaging position EP, the weight body 12 cannot be extracted from the socket 10. At the time of inserting the weight body 12 into the socket 10, the relative relationship between the socket 10 and the weight body 12 is the non-engaging position NP. The relative relationship makes the transition to the engaging position EP from the non-engaging position NP by rotation of a relative angle θ. The relative relationship returns to the non-engaging position NP from the engaging position EP by inverse rotation of the relative angle θ. In the weight body attaching/detaching mechanism M1, the weight body 12 can be attached/detached by merely applying the rotation of the angle θ. The weight body attaching/detaching mechanism M1 has excellent easiness of attachment/detachment.

In the embodiment, the angle θ is 45 degrees. The angle θ is not limited to 45 degrees. Examples of the angle θ include 30 degrees and 60 degrees.

Figure 9:
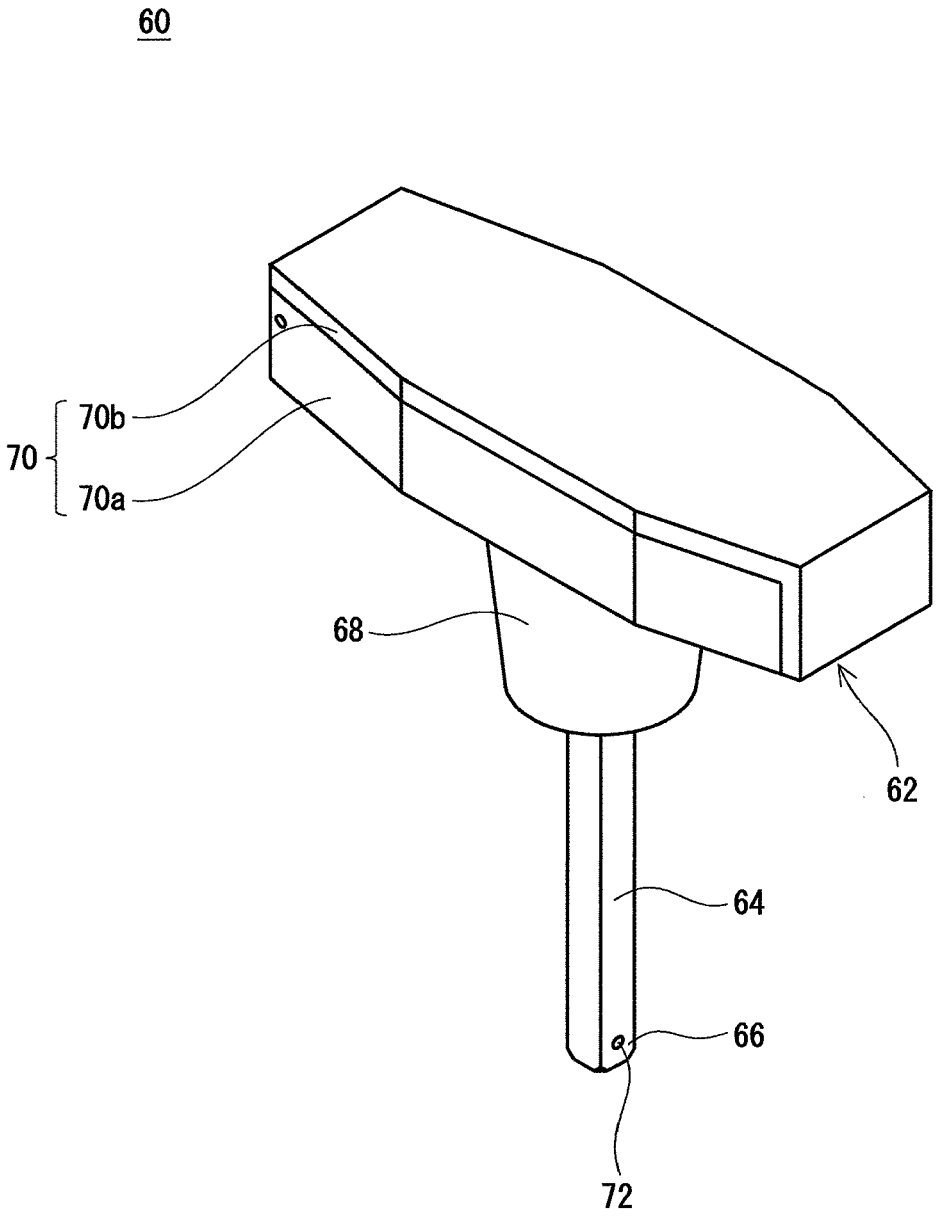
FIG. 9 is a perspective view showing an example of a tool used for attaching/detaching the weight body.

An exclusive tool can be used in the weight body attaching/detaching mechanism M1. FIG. 9 is a perspective view showing a tool 60 as an example of the exclusive tool. The tool 60 is used for attaching/detaching the weight body 12. The tool 60 is provided with a handle 62, a shaft 64, and a tip part 66. The handle 62 has a handle body 68 and a holding part 70. The holding part 70 extends in a direction vertically crossing with a rotation axis of the tool 60 from the first hole part of the handle body 68. The holding part 70 is provided with a holding body part 70*a* and a lid 70*b*.

A back end part of the shaft 64 is fixed to the holding body part 70*a*. A section shape of the tip part 66 of the shaft 64 corresponds to a shape of the noncircular hole 34 of the weight body 12. In the embodiment, the tip part 66 has a quadrangle section. A pin 72 protrudes from a side surface of the tip part 66. The pin 72 is built in the tip part 66. Although not shown in the drawings, an elastic body (coil spring) is built in the tip part 66. The pin 72 is biased in a protruding direction by an biasing force of the elastic body.

When the weight body 12 is attached/detached, the lid 70*b* is closed. A weight body housing part (not shown) is provided in the holding body part 70*a*. Preferably, the weight body housing part can house the plurality of weight bodies 12. The weight bodies 12 can be taken out by opening the lid 70*b*.

Figure 10:
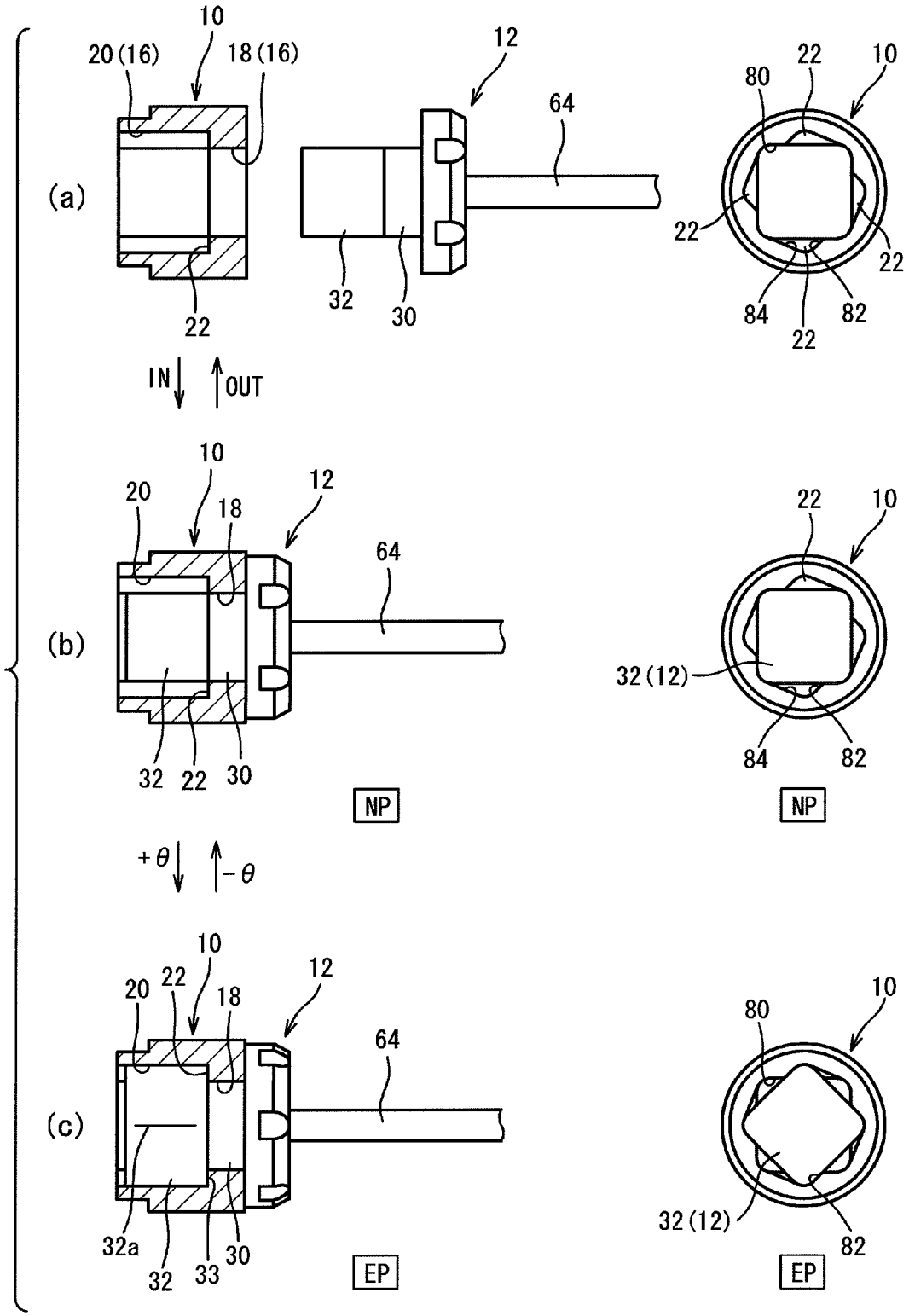
FIG. 10 describes a method for attaching/detaching the weight body.

FIG. 10 is a view for describing an example of a method for attaching/detaching the weight body 12. In FIG. 10, (a) shows a state before the weight body 12 is attached. In FIG. 10, (b) shows a state immediately after the weight body 12 is inserted. In FIG. 10, (c) shows a state where the weight body 12 is rotated and is fixed to the socket 10. In FIG. 10, the socket 10 viewed from the bottom face side is shown on a right end.

The tip part 66 of the tool 60 is inserted into the noncircular hole 34 of the weight body 12 when the weight body 12 is attached. The pin 72 presses the noncircular hole 34 while going backward by the inserting. The weight body 12 is hardly dropped off from the tip part 66 by the pressing force. As shown in (a) and (b) of FIG. 10, the weight body 12 held by the shaft 64 of the tool 60 is inserted into the hole 16.

As shown in (b) of FIG. 10, the engaging part 32 of the weight body 12 passes through the first hole part 18 of the hole 16, and leads to the second hole part 20. In FIG. 10, (b) shows the non-engaging position NP. The weight body 12 can be extracted from the hole 16 at the non-engaging position NP.

Next, relative rotation of an angle θ(+θ) is performed. Specifically, the weight body 12 is rotated by the angle θ (+θ) with respect to the socket 10 using the tool 60. The transition to the engaging position EP from the non-engaging position NP is attained by the rotation. In FIG. 10, (c) shows the engaging position EP. The weight body 12 is fixed to the socket 10 at the engaging position EP. At the engaging position EP, the weight body 12 is not separated by hitting.

When the weight body 12 is removed, reverse rotation of an angle θ is performed. In other words, rotation of an angle −θ is performed. The transition to the non-engaging position NP from the engaging position EP is attained by the rotation. The weight body 12 can be easily removed at the non-engaging position NP.

At the engaging position EP, the weight body 12 cannot be extracted from the hole 16. This is because the extraction of the weight body 12 is inhibited by engaging the bump surface 22 of the hole 16 with the engaging surface 33 of the weight body 12 at the engaging position EP. The tool 60 can be easily extracted from the noncircular hole 34 of the weight body 12 at the engaging position EP.

As shown in FIGS. 5 and 8 or the like, the second hole part 20 of the hole 16 has a surface (non-engagement corresponding surface) 80 corresponding to the engaging part 32 at the non-engaging position NP, a surface (engagement corresponding surface) 82 corresponding to the engaging part 32 at the engaging position EP, and a resistance surface 84. The resistance surface 84 is pressed by (the corner part 32*a* of) the engaging part 32 in the middle of the relative rotation between the non-engaging position NP and the engaging position EP. A frictional force is generated between the engaging part 32 and the second hole part 20 by the pressing. The resistance surface 84 is elastically deformed by the pressing. The material of the second hole part 20 is a comparatively hard polymer, and thereby the frictional force is increased. The increased frictional force generates strong rotation resistance. Strong torque is required for the mutual transition of the non-engaging position NP and the engaging position EP by the rotation resistance. Therefore, the tool 60 is required for the mutual transition. The mutual transition cannot be attained with empty hands without using the tool 60. The weight body 12 located at the engaging position EP is not dropped off by strong impact in hitting.

Thus, the weight body can be attached/detached by merely performing the relative rotation of the angle θ in the weight body attaching/detaching mechanism M1.

The number N1 of the attaching/detaching mechanisms M1 is not limited. In respect of a degree of freedom for adjusting the position of the center of gravity of the head, the number N1 is preferably equal to or greater than 2.

[Hardness Hs of Second Hole Part of Socket]

In view of surely fixing the weight body 12 and of suppressing sounding in hitting, the hardness Hs of the socket 10 is preferably equal to or greater than D40, more preferably equal to or greater than D45, still more preferably equal to or greater than D50, and yet still more preferably equal to or greater than D53. In respect of the easiness of attachment/detachment, the hardness Hs is preferably equal to or less than D58, more preferably equal to or less than D56, still more preferably equal to or less than D55, and yet still more preferably equal to or less than D54. Preferably, the hardness Hs is hardness of a portion elastically deformed in the mutual transition of the engaging position EP and the non-engaging position NP.

The hardness Hs is measured in accordance with regulation of "ASTM-D 2240-68" by using a Shore D type hardness scale attached to an automated rubber hardness measuring device ("P1" (trade name) manufactured by Koubunshi Keiki Co., Ltd.). The shape of a measurement sample is set to a cube having a side having a length of 3 mm. Measurement is performed under a temperature of 23° C. When possible, the measurement sample is cut out from (the second hole part of) the socket. When it is difficult to cut out the measurement sample, a measurement sample made of the same resin composition as that of (the second hole part of) the socket is used.

When a ball is hit by the golf club 2, hitting vibration is transmitted to golf player's hands via the golf club 2. The vibrational energy of the hitting vibration is transformed into the kinetic energy of the weight body 12 housed in the socket 10. The socket 10 and the weight body 12 transform the vibrational energy of the shaft 6 into the kinetic energy of the weight body 12, and thereby the hitting vibration can be alleviated.

[Polymer]

In respect of hardness, the material of the socket is preferably a polymer. Examples of the polymer include a thermosetting polymer and a thermoplastic polymer. Examples of the thermosetting polymer include a phenol resin, an epoxy resin, a melamine resin, a urea resin, an unsaturated polyester resin, an alkyd resin, a thermosetting polyurethane, a thermosetting polyimide, and a thermosetting elastomer. Examples of the thermoplastic polymer include polyethylene, polypropylene, polyvinyl chloride, polystyrene, polytetrafluoroethylene, an ABS resin (acrylonitrile butadiene styrene resin), an acrylic resin, polyamide, polyacetal, polycarbonate, modified polyphenylene ether, polybutylene terephthalate, polyethylene terephthalate, polyphenylene sulfide, polyether ether ketone, thermoplastic polyimide, polyamide imide, and a thermoplastic elastomer.

Examples of the thermoplastic elastomer include a thermoplastic polyamide elastomer, a thermoplastic polyester elastomer, a thermoplastic polystyrene elastomer, a thermoplastic polyester elastomer, and a thermoplastic polyurethane elastomer.

In respect of durability, an urethane-based polymer and polyamide are preferable, and the urethane-based polymer is more preferable. Examples of the urethane-based polymer include polyurethane and a thermoplastic polyurethane elastomer. The urethane-based polymer may be thermoplastic, and may be thermosetting. In respect of moldability, a thermoplastic urethane-based polymer is preferable, and the thermoplastic polyurethane elastomer is more preferable.

In respect of moldability, the thermoplastic polymer is preferable. In respect of hardness and durability, in the thermoplastic polymer, the polyamide and the thermoplastic polyurethane elastomer are preferable, and the thermoplastic polyurethane elastomer is more preferable.

Examples of the polyamide include nylon 6, nylon 11, nylon 12, and nylon 66.

A preferable thermoplastic polyurethane elastomer contains a polyurethane component as a hard segment, and a polyester component or a polyether component as a soft segment. That is, preferable examples of the thermoplastic polyurethane elastomer (TPU) include a polyester-based TPU and a polyether-based TPU. Examples of a curing agent for the polyurethane component include cycloaliphatic diisocyanate, aromatic diisocyanate, and aliphatic diisocyanate.

Examples of the cycloaliphatic diisocyanate include 4,4'-dicyclohexylmethane diisocyanate ($H_{12}$MDI), 1,3-bis(isocyanatomethyl)cyclohexane ($H_6$XDI), isophorone diisocyanate (IPDI), and trans-1,4-cyclohexane diisocyanate (CHDI).

Examples of the aromatic diisocyanate include diphenylmethane diisocyanate (MDI) and toluene diisocyanate (TDI). Examples of the aliphatic diisocyanate include hexamethylene diisocyanate (HDI).

Commercially available examples of the thermoplastic polyurethane elastomer (TPU) include "Elastollan" (trade name) manufactured by BASF Japan Ltd.

Specific examples of the polyester-based TPU include "Elastollan C70A", "Elastollan C80A", "Elastollan C85A", "Elastollan C90A", "Elastollan C95A", and "Elastollan C64D".

Specific examples of the polyether-based TPU include "Elastollan 1164D", "Elastollan 1198A", "Elastollan 1180A", "Elastollan 1188A", "Elastollan 1190A", "Elastollan 1195A", and "Elastollan ET385". The polyether-based TPU is used in examples to be described later.

A fiber reinforced resin containing each of the polymers as a matrix may be used.

[Size c1]

A distance between opposed surfaces of the engaging part 32 is shown by a double pointed arrow c1 in FIG. 7. The size c1 is equal to a length of a side of a square obtained by getting off the roundness of a corner existing in the section of the engaging part 32.

[Size d1]

A longest sectional size of the engaging part 32 is shown by a double pointed arrow d1 in FIG. 7. In the embodiment, the size d1 is a length of a diagonal line of the section (substantially square) of the engaging part 32. The size d1 is a length of a longest cross line Lm (see FIG. 7) of the engaging part 32. Both end points of the longest cross line Lm are shown by symbol p1 in FIG. 7. These points p1 are peaks in the section of the engaging part 32.

[Size F1]

A distance between resistance surfaces 84 opposed to each other is shown by a dashed line double pointed arrow F1 in FIG. 6. The size F1 is measured at a position where elastic deformation is maximized in the mutual transition. The size F1 is correlated with the maximum value of torque required in the mutual transition.

[Size K1]

An opening width of the first hole part 18 of the hole 16 is shown by a double pointed arrow K1 in FIG. 6. The size K1 is equal to a length of a side of a square obtained by getting off the roundness of a corner existing in the section of the first hole part 18.

[Size G1]

A cross length of the second hole part 20 between positions with which both the end points p1 of the longest cross line Lm are brought into contact at the engaging position EP is shown by a double pointed arrow G1 in FIG. 6.

[Size H1]

A length of a shortest cross line Lh of the second hole part 20 is shown by a dashed line double pointed arrow H1 in FIG. 6. Both end points p2 of the shortest cross line Lh are boundary points between an engagement corresponding surface 82 and a non-engagement corresponding surface 80.

[F1/d1]

In respect of suppressing the scraping of the inner surface of the socket when the weight body 12 is attached/detached, a ratio (F1/d1) is preferably equal to or greater than 0.935, more preferably equal to or greater than 0.940, and still more preferably equal to or greater than 0.945. In view of surely fixing the weight body 12 and of suppressing sounding in hitting, the ratio (F1/d1) is preferably equal to or less than 0.965, more preferably equal to or less than 0.960, and still more preferably equal to or less than 0.955.

In the middle of the relative rotation, the amount of deformation of the resistance surface 84 is maximized. As the maximum amount of the deformation is greater, the ratio (F1/d1) is less.

[G1/d1]

In respect of suppressing the scraping of the inner surface of the socket when the weight body 12 is attached/detached, a ratio (G1/d1) is preferably equal to or greater than 0.987, more preferably equal to or greater than 0.989, and still more preferably equal to or greater than 0.991. In view of surely fixing the weight body 12 and of suppressing sounding in hitting, the ratio (G1/d1) is preferably equal to or less than 0.996, more preferably equal to or less than 0.995, and still more preferably equal to or less than 0.994.

[K1−c1]

When a difference (K1−c1) is too small, the catching of the weight body 12 is apt to be caused when the weight body 12 is extracted. Therefore, the smoothness of attachment/detachment may be inhibited. In respect of easily extracting the weight body 12 at the non-engaging position NP, the difference (K1−c1) is preferably equal to or greater than 0.3 mm, more preferably equal to or greater than 0.35 mm, and still more preferably equal to or greater than 0.4 mm.

In the embodiment, a part of the inner surface of the second hole part 20 is flush with the inner surface of the first hole part 18. The flush portion is the non-engagement corresponding surface 80. When the difference (K1−c1) is excessive in the design of the hole 16, the size F1 and/or the size G1 are/is apt to be great. In this case, the holding force of the weight body 12 may be reduced to cause sounding in hitting. In this respect, the difference (K1−c1) is preferably equal to or less than 0.6 mm, more preferably equal to or less than 0.55 mm, and still more preferably equal to or less than 0.5 mm.

[H1/d1]

When a ratio (H1/d1) is too small, the size G1 and/or the size F1 is also apt to be small. In this case, the scraping of the inner surface of the second hole part 20 is apt to be caused. In this respect, the ratio (H1/d1) is preferably equal to or greater than 0.785, more preferably equal to or greater than 0.810, and still more preferably equal to or greater than 0.840.

When the torque is too strong in the transition to the engaging position EP from the non-engaging position NP, the excessive rotation of the weight body 12 may be caused. The weight body 12 may pass through the engaging position EP, and may lead to the non-engaging position NP by the excessive rotation although the transition to the engaging position EP is intended. The excessive rotation of the weight body 12 is suppressed by decreasing the size H1. In respect of suppressing the excessive rotation, the ratio (H1/d1) is preferably equal to or less than 0.915, more preferably equal to or less than 0.890, and still more preferably equal to or less than 0.870.

Under an environment of 40° C., maximum torque (N·m) required in attaching/detaching is defined as T40. Under an environment of 25° C., the maximum torque (N·m) required in attaching/detaching is defined as T25. Under an environment of 5° C., the maximum torque (N·m) required in attaching/detaching is defined as T5. In view of enabling smooth attachment/detachment regardless of a temperature, a ratio (T40/T5) is preferably equal to or greater than 0.30, more preferably equal to or greater than 0.35, still more preferably equal to or greater than 0.40, and yet still more preferably equal to or greater than 0.41.

As shown in data to be described later, the maximum torque required in attaching/detaching depends on a temperature environment. The data to be described later shows that so the temperature is lower, the maximum torque is increased. The data shows that the maximum torque is less at a higher temperature, and the ratio (T40/T5) is equal to or less than 1.

In view of enabling smooth attachment/detachment regardless of a temperature, a ratio (T25/T5) is preferably equal to or greater than 0.57, more preferably equal to or greater than 0.60, and still more preferably equal to or greater than 0.61. As described above, a ratio (T25/T5) is considered to be equal to or less than 1 as in the ratio (T40/T5).

In respect of enabling smooth attachment/detachment at a low temperature, the maximum torque T5 is preferably equal or less than 6.3 (N·m), more preferably equal or less than 6.0 (N·m), still more preferably equal or less than 5.5 (N·m), and yet still more preferably equal or less than 5.0 (N·m).

In respect of ensuring fixation at a high temperature, the maximum torque T40 is preferably equal to or greater than 1.0 (N·m), more preferably equal to or greater than 1.5 (N·m), and still more preferably equal to or greater than 1.8 (N·m).

EXAMPLES

Hereinafter, the effects of the present invention will be clarified by examples. However, the present invention should not be interpreted in a limited way based on the description of the examples.

Example 1

A hollow head body was produced by using a titanium alloy. The head body was obtained by welding a face member and a body member. The face member was obtained by subjecting a rolling material to press processing. "Super TI-X51AF rolling material" (trade name) manufactured by Nippon Steel Corporation was used as the material of the face member. The body member was obtained by lost-wax precision casting. Ti-8Al-2V was used as the material of the body member. The weight of the head body was set to 190 g. Two recessed parts were provided in the head body. A socket and a bottom face forming part were fitted into each of these recessed parts, and were bonded. The socket and the bottom face forming part were obtained by injection molding. "DP460" (trade name) manufactured by Sumitomo 3M Limited was used for the bonding. The shapes of the sockets were set to be the same as that of the above-mentioned socket 10. A thermoplastic polyurethane elastomer was used as the material of the socket. The thermoplastic polyurethane elastomer was obtained by blending "Elastollan 1164D" and "Elastollan 1198A" in a mass ratio of 1:1. Hardness Hs was set to 53 by the material. The material of the bottom face forming part was set to be the same as that of the socket. Two weight bodies were produced. A W—Ni alloy was used as the material of a first weight body. The mass of the first weight body was 11 g. Ti-6Al-4V was used as the material of a second weight body. The mass of the second weight body was 3 g. The outer shapes of the two weight bodies were made the same. A shaft and a grip were attached to the head to obtain a club. The specification and evaluation result of example 1 are shown in the following Table 1.

Examples 2 to 4 and Comparative Examples 1 to 4

Heads of examples 2 to 5 and comparative examples 1 to 4 were obtained in the same manner as in the example 1 except for the specifications shown in Table 1. Hardness Hs was adjusted by changing the mixing ratio of "Elastollan 1164D" and "Elastollan 1198A". A bottom face forming part was not provided in the example 4. The specifications and evaluation results of these examples and comparative examples are shown in the following Tables 1 and 2.

Example 5

A head of example 5 was obtained in the same manner as in the example 1 except that a nylon-based resin was used as the materials of a socket and a bottom face forming part. "Pebax" (trade name) manufactured by Arkema Inc. was used as the nylon-based resin. Hardness Hs was set to 53 as in the example 1. The specification and evaluation result of this example are shown in the following Table 2.

Comparative Example 5

Two sockets were produced. Each socket had a female screw. The material of each socket was an ABS resin. Two weight bodies were produced. Each weight body had a male screw. The material of each weight body was a tungsten nickel alloy. The masses of the two weight bodies were 11 g and 3 g. A head of comparative example 5 was obtained in the same manner as in the example 1 except for the socket and the weight body. The specification and evaluation result of this comparative example are shown in the following Table 2.

[Evaluation]

Evaluation methods are as follows.

[Backlash Between Socket and Weight Body]

The club was attached to a swing robot. The swing robot hit a commercially available two-piece ball at a head speed of 50 m/s. The test was performed under an environment where a temperature was 25° C. It was investigated whether backlash is caused between the socket and the weight body after hitting 10,000 times. The backlash causes sounding to reduce commercial value. The existence or nonexistence of the backlash is shown in the following Tables 1 and 2.

[Scraping in Socket]

After one socket was repeatedly attached/detached 300 times, the scraping of the inner surface of the socket was evaluated. The scraping was evaluated in five stages of scores 0 to 4. The test was performed under an environment where a temperature was 25° C. The score 0 represents the least scraping amount. The score 4 represents the most scraping amount. The evaluation result is shown in the following Tables 1 and 2.

[Catching in Removing]

The rate of the generated catching was evaluated in extracting from a non-engaging position NP. The test of one socket was performed. The test was performed under an environment where a temperature was 5° C. The socket was attached/detached 10 times, and the number of times of the generated catching was counted. The rate (%) of the generated catching is shown in the following Tables 1 and 2.

[Sounding between Head Body and Bottom Face of Weight Body]

The generation of sounding between the bottom face of a recessed part 14 formed in the head body and the bottom face of the weight body was evaluated. The club was attached to the swing robot. The swing robot hit a commercially available two-piece ball 10 times at a head speed of 50 m/s. An evaluator aurally confirmed whether sounding is generated in hitting 10 times. The existence or nonexistence of the sounding is shown in the following Tables 1 and 2.

A weight body located at the engaging position EP was prepared for one socket. The weight body was rotated, and was set to the non-engaging position NP. The weight body was extracted, inserted, and reversely rotated to return the weight body to the engaging position EP again. A time required for a set of attachment/detachment was measured. The average value of attachment/detachment of 10 times is shown in the following Tables 1 and 2.

TABLE 1

Specifications and evaluation results of examples and comparative examples

| | Unit | Example 1 | Comparative example 1 | Comparative example 2 | Comparative example 3 | Comparative example 4 |
|---|---|---|---|---|---|---|
| Material of socket | — | Urethane-based | Urethane-based | Urethane-based | Urethane-based | Urethane-based |
| Hardness Hs of socket | D hardness | 53 | 39 | 60 | 53 | 53 |
| Size d1 of weight body | mm | 11.46 | 11.46 | 11.46 | 11.46 | 11.46 |
| Size F1 of socket | mm | 10.88 | 10.88 | 10.88 | 10.68 | 11.1 |
| F1/d1 | — | 0.949 | 0.949 | 0.949 | 0.932 | 0.969 |
| Size G1 of socket | mm | 11.38 | 11.38 | 11.38 | 11.28 | 11.45 |
| G1/d1 | — | 0.993 | 0.993 | 0.993 | 0.984 | 0.999 |
| Size c1 of weight body | mm | 8.9 | 8.9 | 8.9 | 8.9 | 8.9 |
| Size K1 of socket | mm | 9.3 | 9.3 | 9.3 | 9.3 | 9.3 |
| K1 − c1 | mm | 0.4 | 0.4 | 0.4 | 0.4 | 0.4 |
| Size H1 of socket | mm | 9.74 | 9.74 | 9.74 | 9.74 | 9.74 |
| Existence or nonexistence of bottom face forming part | — | Existence | Existence | Existence | Existence | Existence |
| Maximum torque T40 at 40° C. | N · m | 1.8 | 0.8 | 2.1 | 2.2 | 1.3 |
| Maximum torque T25 at 25° C. | N · m | 2.7 | 1.6 | 3.6 | 3.1 | 2.2 |
| Maximum torque T5 at 5° C. | N · m | 4.4 | 3.2 | 6.4 | 5.1 | 3.9 |
| T40/T5 | — | 0.41 | 0.25 | 0.33 | 0.43 | 0.33 |
| T25/T5 | — | 0.61 | 0.50 | 0.56 | 0.61 | 0.56 |
| Backlash between socket and weight body | — | Nonexistence | Existence | Nonexistence | Nonexistence | Existence |
| Scraping in socket | — | 0 | 0 | 2 | 4 | 0 |
| Catching in removing | (%) | 0 | 0 | 0 | 0 | 0 |
| Sounding between head body and bottom face of weight body | — | Nonexistence | Nonexistence | Nonexistence | Nonexistence | Nonexistence |
| Attaching/detaching time | Second | 0.5 | 0.5 | 0.5 | 0.5 | 0.5 |

TABLE 2

Specifications and evaluation results of examples and comparative examples

| | Unit | Example 2 | Example 3 | Example 4 | Example 5 | Comparative example 5 |
|---|---|---|---|---|---|---|
| Material of socket | — | Urethane-based | Urethane-based | Urethane-based | Nylon-based | — |
| Hardness Hs of socket | D hardness | 53 | 53 | 53 | 53 | — |
| Size d1 of weight body | mm | 11.46 | 11.46 | 11.46 | 11.46 | — |
| Size F1 of socket | mm | 10.88 | 10.88 | 10.88 | 10.88 | — |
| F1/d1 | — | 0.949 | 0.949 | 0.949 | 0.949 | — |
| Size G1 of socket | mm | 11.38 | 11.38 | 11.38 | 11.38 | — |
| G1/d1 | — | 0.993 | 0.993 | 0.993 | 0.993 | — |
| Size c1 of weight body | mm | 8.9 | 8.9 | 8.9 | 8.9 | — |
| Size K1 of socket | mm | 9.0 | 9.7 | 9.3 | 9.3 | — |
| K1 − c1 | mm | 0.1 | 0.8 | 0.4 | 0.4 | — |
| Size H1 of socket | mm | 9.74 | 9.74 | 9.74 | 9.74 | — |
| Existence or nonexistence of bottom face forming part | — | Existence | Existence | Nonexistence | Existence | — |
| Maximum torque T40 at 40° C. | N · m | 2.2 | 1.8 | 1.8 | 1.8 | — |
| Maximum torque T25 at 25° C. | N · m | 3.1 | 2.7 | 2.7 | 2.7 | — |
| Maximum torque T5 at 5° C. | N · m | 5.1 | 4.4 | 4.4 | 4.4 | — |
| T40/T5 | — | 0.43 | 0.41 | 0.41 | 0.41 | — |

TABLE 2-continued

Specifications and evaluation results of examples and comparative examples

| | Unit | Example 2 | Example 3 | Example 4 | Example 5 | Comparative example 5 |
|---|---|---|---|---|---|---|
| T25/T5 | — | 0.61 | 0.61 | 0.61 | 0.61 | — |
| Backlash between socket and weight body | — | Nonexistence | Nonexistence | Nonexistence | Nonexistence | Nonexistence |
| Scraping in socket | — | 0 | 0 | 0 | 3 | — |
| Catching in removing | (%) | 40 | 0 | 0 | 0 | — |
| Sounding between head body and bottom face of weight body | — | Nonexistence | Nonexistence | Existence | Nonexistence | Nonexistence |
| Attaching/detaching time | Second | 5.2 | 0.5 | 0.5 | 0.5 | 10.5 |

As shown in Tables 1 and 2, the examples are highly evaluated as compared with the comparative examples. From the results, the advantages of the present invention are apparent.

The present invention described above can be applied to all golf clubs. The present invention can be used for a wood type club, a utility type club, a hybrid type club, an iron type club, and a putter club or the like.

The description hereinabove is merely for an illustrative example, and various deformations can be made in the scope not to depart from the principles of the present invention.

What is claimed is:

1. A golf club head comprising:

a head body;

a socket attached to the head body; and a weight body capable of being attached to or detached from the socket, wherein the weight body can be attached or detached by relative rotation of an angle θ to the socket;

the weight body has an engaging part;

the socket has a first hole part and a second hole part;

hardness Hs of the second hole part is D40 or greater and D58 or less;

the engaging part can take an engaging position EP and a non-engaging position NP in the second hole part by the relative rotation of the angle θ;

the second hole part has a resistance surface elastically deformed in the middle of the relative rotation; and when a longest sectional size of the engaging part is defined as d1, and a distance between the resistance surfaces opposed to each other is defined as F1, F1/d1 is 0.935 or greater and 0.965 or less; and when a distance between opposed surfaces of the engaging part is defined as c1, and an opening width of the first hole part is defined as K1, a difference (K1−c1) is 0.3 mm or greater and 0.6 mm or less.

2. The golf club head according to claim 1, wherein when a cross length of the second hole part between positions with which both end points p1 of a longest cross line Lm of the engaging part are brought into contact at the engaging position EP is defined as G1, G1/d1 is 0.987 or greater and 0.996 or less.

3. The golf club head according to claim 1, further comprising a bottom face forming part made of the same kind of material as that of the socket.

4. The golf club head according to claim 1, wherein when maximum torque required in attaching/detaching under an environment of 40° C. is defined as T40, and maximum torque required in attaching/detaching under an environment of 5° C. is defined as T5, T40/T5 is equal to or greater than 0.30.

5. The golf club head according to claim 4, wherein the maximum torque T5 is equal to or less than 6.3 (N·m), and the maximum torque T40 is equal to or greater than 1.0 (N·m).

6. The golf club head according to claim 4, wherein the maximum torque T5 is equal to or less than 6.3 (N·m), and the maximum torque T40 is equal to or greater than 1.0 (N·m).

7. The golf club head according to claim 1, wherein a material of the second hole part is an urethane-based polymer.

8. The golf club head according to claim 7, wherein the urethane-based polymer is a thermoplastic polyurethane elastomer.

9. The golf club head according to claim 7, wherein the urethane-based polymer is a thermoplastic polyurethane elastomer.

10. The golf club head according to claim 1, wherein when a length of a shortest cross line of the second hole part is defined as H1, H1/d1 is 0.785 or greater and 0.915 or less.

11. The golf club head according to claim 1, wherein when maximum torque (N·m) required in attaching/detaching under an environment of 25° C. is defined as T25, and maximum torque (N·m) required in attaching/detaching under an environment of 5° C. is defined as T5, a ratio (T25/T5) is equal to or greater than 0.57.

12. The golf club head according to claim 1, wherein when the distance of the engaging part is defined as c1, and an opening width of the first hole part is defined as K1, a difference (K1−c1) is 0.3 mm or greater and 0.6 mm or less.

13. The golf club head according to claim 1, wherein when a cross length of the second hole part between positions with which both end points p1 of a longest cross line Lm of the engaging part are brought into contact at the engaging position EP is defined as G1, G1/d1 is 0.987 or greater and 0.996 or less.

14. The golf club head according to claim 1, wherein when maximum torque required in attaching/detaching under an environment of 40° C. is defined as T40, and maximum torque required in attaching/detaching under an environment of 5° C. is defined as T5, T40/T5 is equal to or greater than 0.30.

15. The golf club head according to claim 1, wherein a material of the second hole part is an urethane-based polymer.

16. The golf club head according to claim 1, wherein when a length of a shortest cross line of the second hole part is defined as H1, H1/d1 is 0.785 or greater and 0.915 or less.

17. The golf club head according to claim 1, wherein when maximum torque (N·m) required in attaching/detaching under an environment of 25° C. is defined as T25, and maximum torque (N·m) required in attaching/detaching under an environment of 5° C. is defined as T5, a ratio (T25/T5) is equal to or greater than 0.57.

18. A golf club head comprising:

a head body;

a socket attached to the head body; and a weight body capable of being attached to or detached from the socket, wherein the weight body can be attached or detached by relative rotation of an angle θ to the socket;

the weight body has an engaging part;

the socket has a first hole part, a second hole part and a bottom face forming part made of the same kind of material as that of the socket;

hardness Hs of the second hole part is D40 or greater and D58 or less;

the engaging part can take an engaging position EP and a non-engaging position NP in the second hole part by the relative rotation of the angle θ;

the second hole part has a resistance surface elastically deformed in the middle of the relative rotation; and when a longest sectional size of the engaging part is defined as d1, and a distance between the resistance surfaces opposed to each other is defined as F1, F1/d1 is 0.935 or greater and 0.965 or less.

* * * * *